US005810663A

United States Patent [19]

Bochichio et al.

[11] Patent Number: 5,810,663

[45] Date of Patent: Sep. 22, 1998

[54] METHOD OF PLAYING A HIGH/LOW CARD GAME

[75] Inventors: Joseph V. Bochichio, Cortlandt Manor; Robert S. Pinchbeck, Mahopac Falls, both of N.Y.

[73] Assignee: Mambo Gaming Company, LLC, Peekskill, N.Y.

[21] Appl. No.: 917,133

[22] Filed: Aug. 25, 1997

Related U.S. Application Data

[60] Provisional application No. 60/043,585 Apr. 12, 1997.

[51] Int. Cl.[6] ..... A63F 1/00

[52] U.S. Cl. ..... 463/13; 273/292

[58] Field of Search ..... 273/292, 274, 273/309; 463/13

[56] References Cited

U.S. PATENT DOCUMENTS

| | | | |
|---|---|---|---|
| 4,836,553 | 6/1989 | Suttle | 273/292 |
| 5,022,653 | 6/1991 | Suttle | 463/13 |
| 5,294,128 | 3/1994 | Marquez | 273/292 |
| 5,332,228 | 7/1994 | Schultz | 273/292 |
| 5,374,067 | 12/1994 | Jones | 273/292 |
| 5,380,012 | 1/1995 | Jones | 273/292 |
| 5,382,025 | 1/1995 | Sklansky | 273/292 |
| 5,494,295 | 2/1996 | Potter et al. | 273/292 |
| 5,697,614 | 12/1997 | Potter et al. | 273/292 |

OTHER PUBLICATIONS

Scarne's Encyclopedia Card Games, Copyright 1983, p. 28.

*Primary Examiner*—Benjamin H. Layno
*Attorney, Agent, or Firm*—Natter & Natter

[57] ABSTRACT

In a high/low card game, individual players place an ante and are dealt three cards, face down while the dealer is dealt four cards, one of which is face up and the others, face down. Players may then fold, and forfeit their ante or bet. Their hand is either a high hand or a low hand against the dealer. Any three of the dealer's four cards are employed to present a high hand and any three of the dealer's cards are also employed to present a low hand. If the dealer's high hand and low hand are not of predetermined rank, the respective high hand and low hand players win prescribed odds on their bet dependent upon the rank of their hand and keep their ante. If the dealer's hand is of higher rank than the hand of a player who has bet for a high hand or of lower rank than a player who has bet for a low hand and the dealer's rank was sufficient to qualify, the respective betting players lose both the ante and their bet.

13 Claims, 4 Drawing Sheets

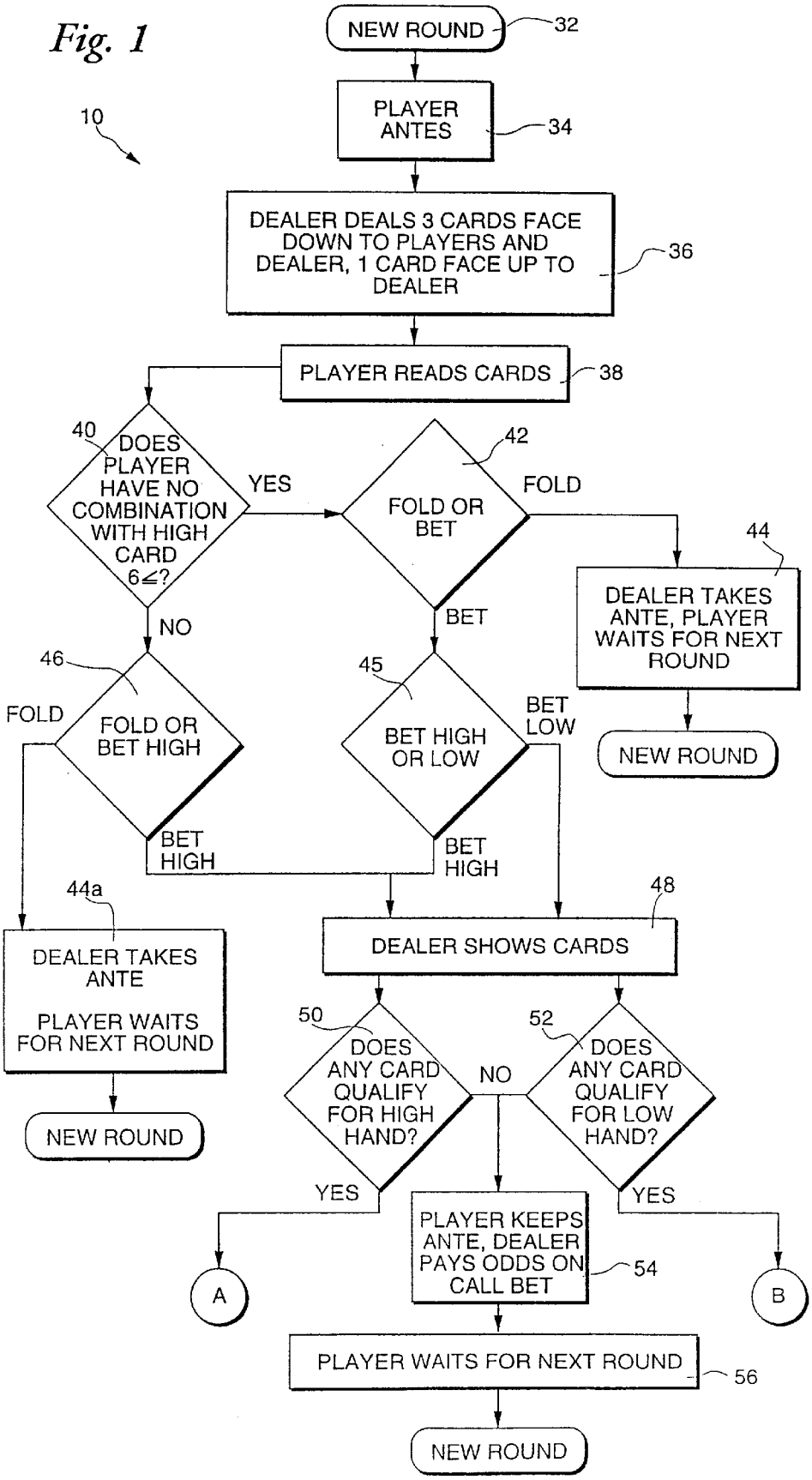
Fig. 1
10
NEW ROUND
32
PLAYER ANTES
34
DEALER DEALS 3 CARDS FACE DOWN TO PLAYERS AND DEALER, 1 CARD FACE UP TO DEALER
36
PLAYER READS CARDS
38
40
DOES PLAYER HAVE NO COMBINATION WITH HIGH CARD 6≤?
YES
42
FOLD OR BET
FOLD
44
DEALER TAKES ANTE, PLAYER WAITS FOR NEXT ROUND
NEW ROUND
NO
BET
46
FOLD OR BET HIGH
45
BET HIGH OR LOW
BET LOW
FOLD
BET HIGH
BET HIGH
44a
DEALER TAKES ANTE
PLAYER WAITS FOR NEXT ROUND
NEW ROUND
48
DEALER SHOWS CARDS
50
DOES ANY CARD QUALIFY FOR HIGH HAND?
NO
52
DOES ANY CARD QUALIFY FOR LOW HAND?
YES
YES
A
PLAYER KEEPS ANTE, DEALER PAYS ODDS ON CALL BET
54
B
PLAYER WAITS FOR NEXT ROUND
56
NEW ROUND

METHOD OF PLAYING A HIGH/LOW CARD GAME

RELATED APPLICATION

This application claims the benefit of U.S. Provisional Application No. 60/043,585 filed Apr. 12, 1997.

BACKGROUND OF THE INVENTION

1. Field of the Invention

This invention relates generally to card games and more particularly to high/low poker variant card games.

2. Antecedents of the Invention

Card games, and particularly poker, are commonly played throughout the world. Poker provides an exciting pastime for social groups, and ranks relatively high in the diverse variety of leisure time entertainment activities.

Poker itself is not a single game within the confines of a strict set of rules but, the term "poker" has been applied to a variety of games, i.e. variants, played with differences in rules. The principle rules of play of poker, however, have been the same for all variants and can be classified in four groups: draw, stud, low ball and mixtures, such as high/low.

Generally, the winner of a round in a poker game is the player who has the best poker hand among those players who have remained in the game. The hand in almost all variants of poker comprises five cards which are ranked as follows, from the highest order to the lowest order:

1. Royal Flush (all cards of the same suit in sequence, from Ace through 10);
2. Straight Flush (all cards of the same suit in sequence);
3. Four of a Kind (four cards of the same rank);
4. Full House (three cards of one rank, two cards of another rank);
5. Flush (all cards of the same suit, not in sequence);
6. Straight (all cards in sequence, not of the same suit);
7. Three of a Kind (three cards of one rank);
8. Two pairs (two cards of one rank, two cards of another rank);
9. One Pair (two cards of one rank); and
10. High Card (no combination).

Attempts have been made to adapt a poker type game into a casino format wherein players did not play against each other for a common pot, but wherein each player individually played against a dealer. An example of one such attempt is the poker game disclosed in U.S. Pat. No. 4,836,553. While the game described therein did afford an opportunity for all players to play against a dealer, the number of opportunities for winning odds on one's wager was limited in that all players were required to play for the high hand.

There remained a need, however, for a poker variant game suitable for casino play which would be played with a reduced number of cards in a hand, which would provide enhanced entertainment features by affording players an opportunity to play for either a high winning hand or a low winning hand against a dealer, which game would include an opportunity for players to employ strategies and which would provide multiple opportunities for winning odds on a player's wager, regardless of qualifying the dealer's hand.

SUMMARY OF THE INVENTION

The present invention relates to a variant poker game wherein each individual player plays against a dealer and is afforded an opportunity to wager, i.e. place a call bet, that his hand has a poker rank either higher or lower than the dealer's hand.

After placing an ante comprising one or more chips or tokens of predetermined monetary value, each player is dealt three cards face down and the dealer is dealt four cards, one of which is face up and the others, face down. Upon each player's examination of the three cards dealt and examining the dealer's face up card, each player decides to either fold, and forfeit the ante or place a call bet in an amount which may be equal to or specified multiples of the ante. Each player signifies, in betting, whether the player's hand is being bet as a high hand or as a low hand as compared to the dealer's hand.

After all call bets have been placed, all hands are exposed and the dealer is required to try to qualify a three card high hand as well as a three card low hand from the four dealer cards. The dealer qualifies with a high hand if the dealer has at least an ace high card. The dealer qualifies for a low hand if any one of the dealer's cards is of a value of six or less.

If the dealer's hand does not qualify as a high hand, each high hand players keeps their ante and are paid odds on their call bets with the odds being a function of the rank of the player's hand.

If the dealer does not qualify for a low hand, the low hand players keep their ante and each is paid odds on their call bets, with the odds being a function of the rank of the player's hand.

If the dealer's hand qualifies and is of higher value, than the player's high hand or is of lower value than the player's low hand, the player loses both the ante and the call bet.

From the foregoing compendium, it will be appreciated that it is an aspect of the present invention to provide a high/low card game of the general character described which is not subject to the disadvantages of the antecedents aforementioned.

It is a feature of the present invention to provide a high/low card game of the general character described which is simple to play.

A consideration of the present invention is to provide a high/low card game of the general character described which is entertaining.

Another feature of the present invention is to provide a high/low card game of the general character described wherein players are afforded high or low betting options as well as structured odds on winning hands.

A further aspect of the present invention is to provide a high/low card game of the general character described wherein call bets are wagered based upon the anticipated ranking of a player's hand as against a dealer's hand.

To provide a high/low card game of the general character described which embodies a wagering structure that accommodates conservative as well as aggressive styles of play is another aspect of the present invention.

A further feature of the present invention is to provide a high/low card game of the general character described wherein players are afforded structured odds if a dealer's hand fails to qualify.

Another consideration of the present invention is to provide a high/low card game of the general character described wherein effective wagering is premised upon strategic considerations.

Yet another aspect of the present invention is to provide a high/low card game of the general character described which proceeds at a rapid pace while at the same time affording wagering opportunities.

A further feature of the present invention is to provide a high/low card game of the general character described which is easy to learn.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations and certain other aspects, features and considerations are attained, all with reference to the accompanying drawings and the scope of which will be more particularly pointed out in the appended claims.

BRIEF DESCRIPTION OF THE DRAWINGS

In the accompanying drawings in which are shown some of the various possible exemplary embodiments of the invention:

FIG. 1 is a schematized flow chart illustrating the method of playing a high/low card game in accordance with the present invention.

DESCRIPTION OF THE PREFERRED EMBODIMENT

Figure 3:
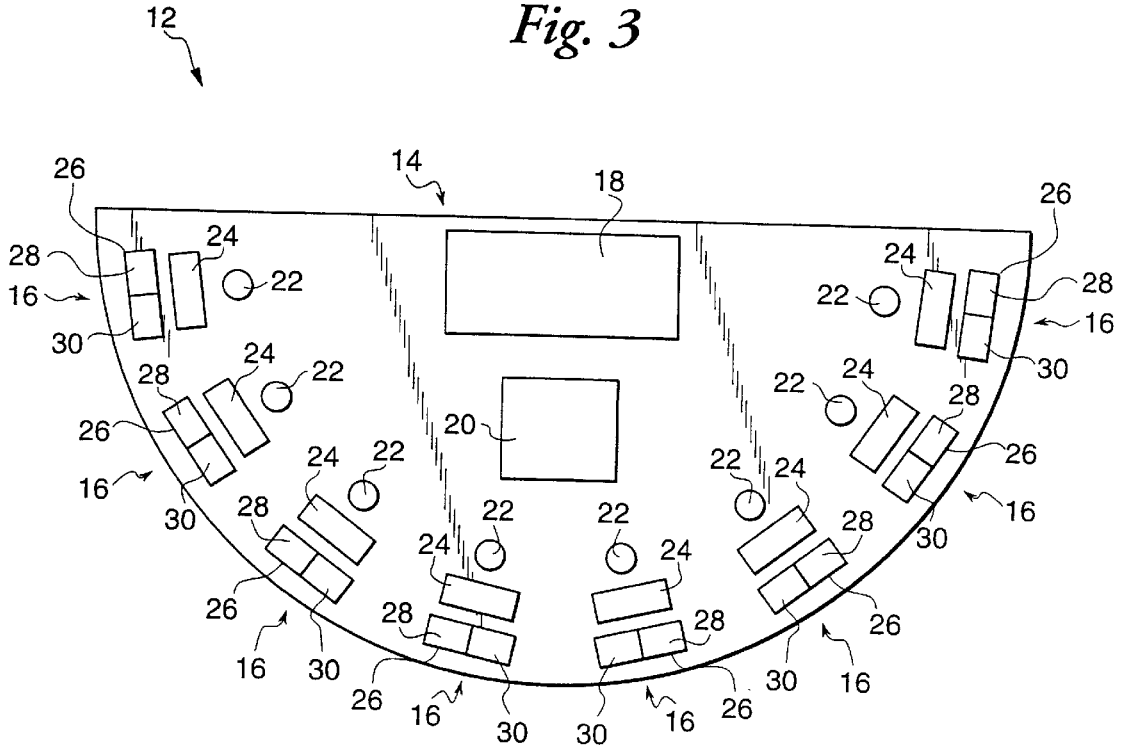
FIG. 3 is a top plan view of a typical gaming table layout for use in playing the high/low card game of the present invention.

Referring now in detail to the drawings, the reference numeral 10 denotes generally a flow chart illustrating the steps employed in playing the high/low card game of the present invention. The game may be played upon a conventional gaming table 12 whose layout is depicted in FIG. 3. The table layout includes provisions for a dealer station, denoted generally by the numeral 14 and a plurality of player stations, denoted generally by the numeral 16. The gaming table layout may also include an area 18, designated for a chip or token rack and an area 20 designated for placement of the dealer's cards.

Positioned in front of each player station 16 is an area 22 for the placement of each player's cards, an area 24 for the placement of tokens or chips representing each player's ante and an area 26 for the placement of tokens or chips representing each player's call bet.

It should be noted that each call bet area 26 is divided into two zones, one zone 28, being employed to designate that the player is betting a high hand and the other zone 30, being employed to indicate that a player is betting a low hand.

The high/low card game of the present invention may be played with a deck of standard playing cards; although a single deck is preferred, any number of decks may be combined.

At the commencement of each new round, indicated in a block 32 in FIG. 1, the dealer shuffles the cards, (if a single deck of cards is employed) and each player places one or more chips or tokens, according to the preestablished house rules, in his respective ante area 24, as indicated in a block 34.

The dealer thereafter deals three cards face down to all players, three cards face down to the dealer and one card face up to the dealer as indicated in a block 36. Thereafter, all players read their cards as indicated in a block 38.

The play of the game in accordance with the steps sequenced in the flow chart 10 then enters an inquiry box 40 wherein each player ascertains whether or not they have a no combination hand with all cards having a value of six or less as indicated in a block 40. If the answer is yes, the player then enters an inquiry box 42 wherein the player decides whether or not to wager on the hand. If the player does not wish to wager, the player folds and the dealer takes the player's ante with the player awaiting the next round as indicated in a box 44.

Alternatively, if the player elects to wager his hand in the inquiry box 42, play of the game enters a further inquiry box 45, wherein the player determines whether to wager his hand a high hand or a low hand.

Returning to the inquiry box 40, if the player's hand was not a no combination with a high card of six or less, the player cannot wager his hand as a low hand. The player then enters an inquiry box 46 wherein the player determines whether to fold or wager his hand as a high hand. If the player folds, the dealer takes the ante and the player waits for the next round as indicated in a box 44*a*.

In the event the player indicates that he is betting high, upon leaving the inquiry box 45 or 46, appropriate tokens or chips each of which may comprise the same value as the ante or multiples of the ante are placed by the player in the high call bet zone 28 in front the player's station 16. If, on the other hand, the player exits the inquiry box 45 by determining to place a low call bet, the player will place one or more tokens or chips in the low betting zone 30. If the player places a low call bet with a hand which did not qualify, a suitable penalty may be imposed, e.g. loss of ante and/or call bet.

After all players who have not folded have placed chips or tokens representing their call bets in the appropriate high or low betting zones 28, 30, the dealer shows the remaining three cards of the dealer's hand, as indicated in a block 48.

The ranking of player high hands and low hands pursuant to the present invention is similar to the ranking in five card poker hands. Three card hands are ranked, under the present invention, as follows, from the highest order to the lowest order:

1. ROYAL FLUSH (Ace, King, Queen, of the same suit);
2. STRAIGHT FLUSH (three cards of the same suit in sequence);
3. THREE OF A KIND (Trips—three cards of one rank);
4. FLUSH (three cards of the same suit, not in sequence);
5. STRAIGHT (three cards in sequence, not of the same suit);
6. ONE PAIR (two cards of one rank, one card of another rank); and
7. HIGH CARD (no combination).

If a player qualifies, i.e. has a no combination hand with a high card of six or less, and elects to place a call bet for a low hand, low hands are ranked, from the highest order to the lowest order, as follows:

1. LOW RUNT (4, 2 and Ace, no more than two cards of one suit); and
2. LOW OTHER (6, 5 and 3, with no more than two cards of one suit).

After all of the dealer's cards have been exposed, as indicated in the block 48, the dealer must attempt to make any high or low three card combination from the four dealer cards. In the event one or more players have wagered for a high hand, the game enters an inquiry box 50 where a determination is made whether or not the dealer's hand qualifies as a high hand. Under the rules of play, any standard may be established for qualification of a high hand such as, for example, a hand with no combinations but an ace high card.

If any player or players have placed a call bet for a low hand, the play enters an inquiry box 52, wherein the dealer's four cards are examined to determine whether or not the dealer has a hand with a card of six or lower.

In the event the answer to the high hand qualification inquiry of box 50 or the low card qualification inquiry of box 52 is negative, that is the dealer's hand does not qualify, the respective high or low players keep their ante and the dealer pays odds on the call bet placed, all as indicated in a box 54. Alternately, the players may be paid on their ante as well, e.g. 1 to 1. Thereafter, the winning players wait for the next round as indicated in a box 56.

A table illustrating forth several examples of dealer's hands, whether such hands qualify and the relative value of such hands is found below:

| Dealer's 4 cards | Best High Hand | Q? | Value | Best Low Hand | Q? | Value |
|---|---|---|---|---|---|---|
| A♥ 7♥ 7♠ 8♠ | A♥ 8♥ 7♥ | Y | Flush - A87 | 8♥ 7♠ A♥ | Y | 871 |
| 2♥ 7♥ 3♠ 8♥ | 8♥ 7♥ 2♥ | Y | Flush - 872 | 7♥ 3♠ 2♥ | Y | 732 |
| 4♥ 7♠ K♠ 8♥ | K♠ 8♥ 7♠ | N | N/A | 8♥ 7♠ 4♥ | Y | 874 |
| 4♥ 7♠ A♠ 8♥ | A♠ 8♥ 7♠ | Y | A87 | 7♠ 4♥ A♠ | Y | 741 |
| 4♥ 4♠ A♠ 2♥ | 4♠ 4♥ A♠ | Y | Pair - 4A | 4♥ 2♥ A♠ | Y | Low Runt |
| K♥ K♠ Q♠ J♥ | K♠ Q♠ J♥ | Y | Straight - KQJ | K♠ K♥ J♥ | N | N/A |
| 5♥ 5♠ 5♣ 5♦ | 5♠ 5♦ 5♥ | Y | Trips - 555 | 5♠ 5♦ 5♥ | Y | Trips |

Figure 2:
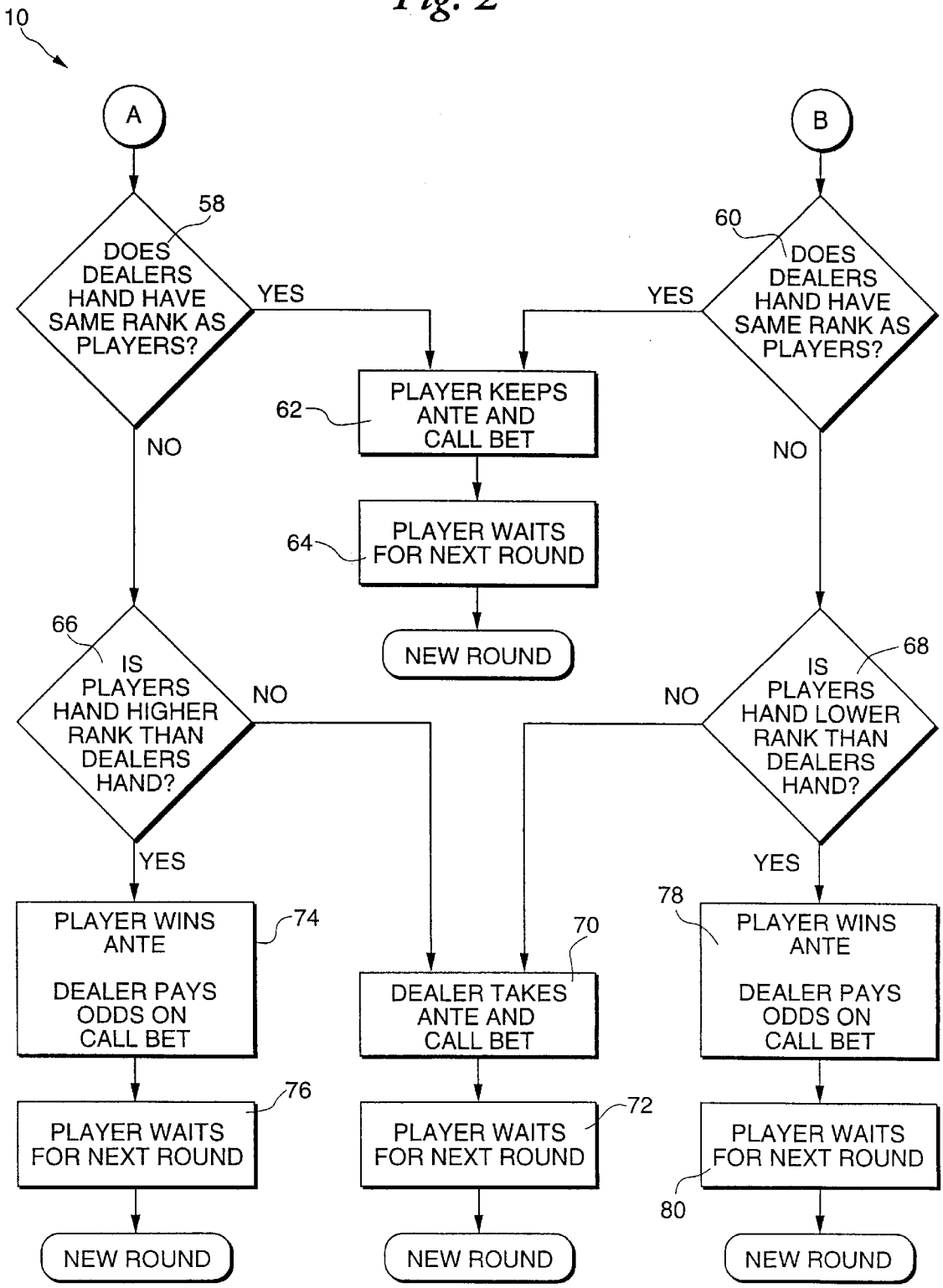
FIG. 2 is a continuation of the flow chart of FIG. 1.

If the dealer's hand qualifies for either a high hand or a low hand, the game proceeds as indicated in FIG. 2 and an inquiry is made as to whether or not the dealer's hand is of the same value as each high betting player's hand as indicated in an inquiry box 58.

In the event the dealer's high hand is of the same value as any high player's hand, the respective player keeps the ante and the call bet as indicated in a box 62. The player thereafter waits for the next round as indicated in a box 64.

Simultaneously, an inquiry is made as to whether the dealer's hand of three selected cards out of the four dealt cards is of the same value as the hand of each low betting player as indicated in a question box 60. If the dealer's low hand has the same value as any low player's hand, the play exits inquiry box 60 and the respective player keeps both the ante and the call bet as indicated in box 62. The player then waits for the next round as indicated in box 64.

When the dealer's high hand is not of the same value as the player's, play proceeds to an inquiry box 66 wherein it is determined whether or not the player's hand is of higher value than the dealer's hand. Similarly, with respect to any low hand players, play proceeds from the inquiry box 60 to an inquiry box 68 wherein it is determined whether or not the player's low hand is lower in value than the dealer's low hand.

In the event the answer in inquiry box 66 or 68 is negative, the dealer has won and the dealer takes the player's ante and call bet as indicated in a box 70. The losing players then wait for the next round as indicated in a box 72.

When the answer to the inquiry of box 66 is positive, that is, the player's hand is higher in value than the dealer's hand, the player wins the ante and the dealer pays predetermined odds on each winning player's call bet, depending upon the rank of the player's winning hand as indicated in box 74. Optionally, odds may also be paid, e.g. 1 to 1, on the winning player's ante. Thereafter, the winning player waits for the next round as indicated in a box 76.

With respect to low hand winning players, in the event the answer to the inquiry in inquiry box 68 is positive, the winning low hand player wins the ante and the dealer pays odds on the winning player's call bet with the odds being a function of the winning player's hand as indicated in box 78. Optionally, odds may also be paid, e.g. 1 to 1, on the winning player's ante. Thereafter, the winning player waits for the next round as indicated in box 80.

The following is a table of suggested payoff schedules on each call bet with respect to various winning hand rankings under conditions of the dealer qualifying and the dealer not qualifying:

| RANK | DEALER QUALIFYING | DEALER NOT QUALIFYING |
|---|---|---|
| LOW HANDS: | | |
| LOW RUNT | 10 | 10 |
| LOW OTHER | 1 | 1 |
| HIGH HANDS: | | |
| ROYAL FLUSH | 100 | 100 |
| STRAIGHT FLUSH | 20 | 10 |
| THREE OF A KIND | 10 | 5 |
| FLUSH | 3 | 1 |
| STRAIGHT | 2 | 1 |
| ONE-PAIR | 1 | 1 |
| HIGH OTHER | 1 | 1 |

Figure 4:
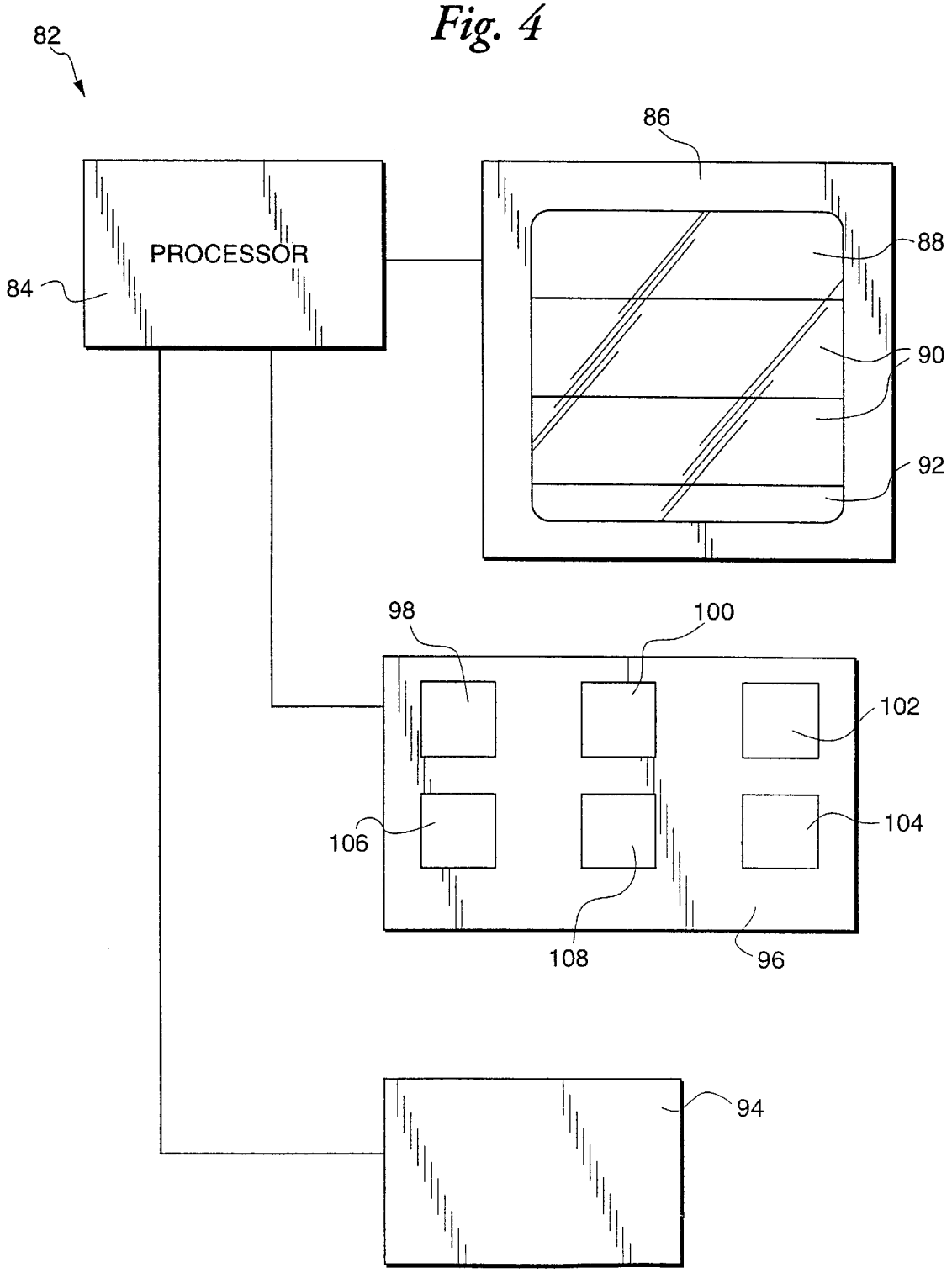
FIG. 4 is a schematized block diagram of an electronic video game incorporating the present invention.

An electronic video gaming apparatus 82 constructed in accordance with the present invention is depicted schematically in FIG. 4. The electronic video gaming apparatus 82 includes a processor 84 programmed to implement the various steps of the game as depicted in the flow chart of FIG. 1 and FIG. 2.

Coupled to the processor 84 is a display 86 having a designated dealer's hand display area 88 and one or more player hand display areas 90. An auxiliary display area 92 is provided for additional player information such as the status of the player's account, i.e. gaming token credits against which winnings are credited and antes and call bets are debited.

A combined token collector and payout dispenser 94 is also interconnected to the processor 84. The collector/dispenser 94 may include a coin slot for collecting and reading tokens or optionally, a magnetic reader for debiting a pre-paid wager card, and other encoded cards such as credit or debit cards. The collector/dispenser 94 can be configured to dispense a player's winnings in token format, credit the player's magnetic card or otherwise dispense a player's winnings and/or credit balance.

A keypad 96 is also connected to the processor 84. The keypad 96 includes a plurality of individual keys for actuation by a player. Included amongst the keys is a key 98 which is depressed to initiate the processor to "deal" a dealer's hand of three cards face down and one card face up in the dealer's hand display area 88 and also to deal a player's hand of three cards in one of the player card areas 90. The processor 84 is programmed to randomly select and display card values and suits in simulation of dealing cards from a shuffled deck of cards. Actuation of the deal key 98 may also serve to debit the player's account as carried in the apparatus memory, the amount of the player's ante or the ante may be deducted at the end of each round.

If a player is unsatisfied with the hand displayed, the player can actuate a "fold" key 100. Alternately, if a player wishes, a high bet key 102 may be actuated. Successive actuations of the high bet key is recognized by the processor as an increase in the amount of the player's wager.

If the player's hand displayed in the player card area 90 qualifies as a low hand, the player may actuate a low bet key 104. As with the high bet key 102, successive actuations of the key 104 are recognized by the processor to increase the amount of the player's wager. A further key 106, is provided for a single player to wager multiple hands, with each hand being displayed in a different player card area 90 of the display and with the keys 100, 102 and 104 being employed to indicate whether the player will fold, bet high or bet low and the amount of the player's call bet with respect to each displayed player hand.

When the player is finished playing and the auxiliary display area indicates that the player has an account credit, a payout key 108 is actuated and the credit and or winnings of the player is dispensed at the collector/dispenser 94.

It should be appreciated that the processor 84 is programmed to implement the steps set forth in the flow chart of FIG. 1 and FIG. 2. Upon a player actuating the "deal" key 98, the processor debits from the player's account the player's ante as indicated in box 34. The processor than deals the player cards and the dealer cards as indicated in box 36.

The player then proceeds through inquiry boxes 40, 42, 45 and 46 by depressing the appropriate keys. Thereafter, the processor displays the three covered dealer cards in the dealer's hand display area 88 as indicated in box 48. The processor then proceeds through inquiry boxes 50, 52, 58, 60, 66 and 68.

The processor 84 is programmed to pay out structured odds according to the value of a winning player's hand by crediting the player's account, in the event the dealer did not qualify or in the event the player's hand is of higher value than the dealer's hand. Similarly, the processor is programmed to debit the player's account the amount of the player's call bet if the player's hand is of lower value than the dealer's qualifying hand.

The player's ante may be immediately debited from the player's account at the commencement of each round and for each additional hand when the multiple hand key 106 is actuated or the ante(s) are debited at the end of each round or returned as provided in the appropriate circumstances, e.g. box 62, box 62*a* and box 54.

It is also within the purview of the present invention that the electronic video gaming apparatus 82 need not be a stand alone unit and may be implemented through on-line computer networks with a host computer at a website performing the processor implemented steps of the game as depicted in the flow chart of FIG. 1 and FIG. 2.

In such instance, the keypad 96 may comprise a keypad, mouse, track ball, touch pad, track point or touch screen of the player's personal computer with the keys comprising either keyboard keys or visual keys on the display or touch screen which are actuated in conjunction with the mouse, track ball, etc.

Suitable means for collection of user value units may comprise crediting the user's account with debits from a credit or debit card through voice communication or other electronic transfer, e.g. through the on-line network and implemented by suitable programming at the host computer. Similarly, the player's credit balance may be transferred or "dispensed" at the end of play by electronic funds transfer, credit or debit card account transfers or by mail, for example, all of which should be construed within the ambit of means implemented through the processor for dispensing the player's account balance at the end of play.

Thus it will be seen that there is provided a high/low card game which achieves the various aspects, features and considerations of the present invention and which is well suited to meet the conditions of practical usage.

As various changes might be made in the high/low card game above set forth, it is to be understood that all matters herein described are shown in the accompanying drawings is to be interpreted as illustrative and not in a limiting sense.

Having thus described the invention there is claimed as new and desired to be secured by Letters Patent:

1. A method of playing a high/low card game comprising the steps of:

a) a player placing an ante, b) a dealer dealing a hand of a first number of cards to each player, c) a dealer dealing a hand of a second number of cards to the dealer, the second number comprising at least one more card than the first number, with one of the dealer's cards being face up and the remainder being face down, d) each player examining the hand of cards dealt to each player by the dealer, e) each player either folding or placing a call bet against the dealer's hand, f) each player designating the call bet to be either that the value of the player's hand is higher than the value of the dealer's hand or that the value of the player's hand is lower than the value of the dealer's hand, g) exposing the dealer's face down cards, h) selecting from all of the cards in the dealer's hand, a group of cards which constitutes the highest value of a hand comprising the first number of cards, i) comparing the value of the dealer's hand selected in step (h) with the value of the hand of each player who placed a call bet for a high hand in step (f), j) if the player's hand is of a higher value than the dealer's hand, the player winning predetermined odds on the player's call bet, with the odds being a function of the value of the player's hand, k) if the player's hand is of a lower value than the dealer's hand, the player forfeiting the ante and the call bet to the dealer, l) selecting from all of the cards of the dealer's hand, a group of cards which constitutes the lowest value of a hand comprising the first number of cards, m) comparing the value of the dealer's hand selected in step (l) with the value of the hand of each player who placed a call bet for a hand lower than the dealer's hand in step (f), n) if the player's hand is of a lower value than the dealer's hand, the player winning predetermined odds on the player's call bet with the odds being a function of the value of the player's hand, and o) if the value of the player's hand is higher than the value of the dealer's hand, the player forfeiting the ante and the call bet to the dealer.

2. A method of playing a high/low card game in accordance with claim 1 wherein if the value of the player's hand is equal to the value of the dealer's hand in steps (i) or (m), the player keeping the ante and the call bet.

3. A method of playing a high/low card game in accordance with claim 1 further including the step of:

p) providing a minimum value for the dealer's hand selected in step (h) and a maximum value for the dealer's hand selected in step (l), the method further including the steps of, q) comparing the value of the dealer's hand as selected in step (h) with the minimum value, r) if the dealer's hand has a value lower than the minimum value, the players who wagered for a high hand in step (f) winning predetermined odds on the player's call bet, with the odds being a function of the value of the player's hand, s) comparing the value of the dealer's hand selected in step (l) with the maximum value, t) if the dealer's hand has a value higher than the maximum value, the players who wagered for a low hand in step (f) winning predetermined odds on the player's call bet, with the odds being a function of the value of the player's hand.

4. A method of playing a high/low card game in accordance with claim 3 wherein the dealer's minimum value must be a hand of at least an ace high card.

5. A method of playing a high/low card game in accordance with claim 3 wherein the dealer's maximum value is a hand of at least one card of six or less.

6. A method of playing a high/low card game in accordance with claim 1 wherein each player who folds forfeits the ante.

7. A method of playing a high/low card game in accordance with claim 1 wherein the first number of cards is three and the second number of cards is four.

8. A method of playing a high/low card game in accordance with claim 1 wherein the call bet comprises a multiple of the value of the ante.

9. A method of playing a high/low card game in accordance with claim 1 wherein the dealer deals hands from a deck of standard playing cards.

10. A method of playing a high/low card game in accordance with claim 1 further including the step of predetermining a maximum value of a player's hand for a player to place a call bet that the value of the player's hand is lower than the value of the dealer's hand in step (f).

11. A method of playing a high/low card game in accordance with claim 1 wherein the maximum value of the player's hand is a no combination hand wherein the value of the highest card is six or less.

12. A method of playing a high/low card game in accordance with claim 1 wherein step (j) includes the step of the dealer returning odds on the winning player's call bet.

13. A method of playing a high/low card game in accordance with claim 1 wherein the value of the dealer's hand and the value of the hand of each player is determined by poker rank.

* * * * *

UNITED STATES PATENT AND TRADEMARK OFFICE

CERTIFICATE OF CORRECTION

PATENT NO. : 5,810,663

DATED : September 22, 1998

INVENTOR(S) : Joseph V. Bochichio and Robert S. Pinchbeck

It is certified that error appears in the above-indentified patent and that said Letters Patent is hereby corrected as shown below:

In the drawings, Sheet 3, Fig. 3, in the four call bet areas 26 on the right side of the figure, the reference numeral "30" should read --28-- and the reference numeral "28" should read --30--. Column 4, line 43 should read: --4. STRAIGHT (three cards in sequence, not of the same suit);--. Column 4, lines 44-45 should read: --5. FLUSH (three cards of the same suit, not in sequence);--. In columns 5-6 on the first line beneath the table headings, the "eight of spades symbol" should read: --eight of hearts symbol--. In column 6, in the eighth line beneath the table headings, "FLUSH" should read --STRAIGHT--. In column 6, in the ninth line beneath the table headings "STRAIGHT" should read --FLUSH--. In column 8, line 21, "are" should read --or--.

Signed and Sealed this

Fourteenth Day of November, 2000

*Attest:*

Q. TODD DICKINSON

*Attesting Officer*

*Director of Patents and Trademarks*